US008555426B2

(12) United States Patent
Kamradt

(10) Patent No.: US 8,555,426 B2
(45) **Date of Patent: *Oct. 15, 2013**

(54) ENERGY ABSORBING AND DISPLACING STRUCTURE FOR ATHLETIC PROTECTIVE EQUIPMENT

(76) Inventor: Brian Kamradt, Indianapolis, IN (US)

( * ) Notice: Subject to any disclaimer, the term of this patent is extended or adjusted under 35 U.S.C. 154(b) by 96 days.

This patent is subject to a terminal disclaimer.

(21) Appl. No.: 13/201,421

(22) PCT Filed: Feb. 2, 2010

(86) PCT No.: PCT/US2010/000290

§ 371 (c)(1),
(2), (4) Date: Aug. 12, 2011

(87) PCT Pub. No.: WO2010/093417

PCT Pub. Date: Aug. 19, 2010

(65) Prior Publication Data

US 2011/0289663 A1 Dec. 1, 2011

Related U.S. Application Data

(63) Continuation of application No. 12/378,273, filed on Feb. 13, 2009, now Pat. No. 7,917,971.

(51) Int. Cl.

| | |
|---|---|
| ***G21F 3/02*** | (2006.01) |
| ***G21F 1/12*** | (2006.01) |
| *G21F 1/00* | (2006.01) |

(52) U.S. Cl.
USPC ..... 2/455; 2/456; 2/467; 2/2.5; 2/267

(58) Field of Classification Search
USPC ..... 2/455, 456, 459–467, 2.5, 22–24, 62, 2/311–322, 267, 268, 910, 911
See application file for complete search history.

(56) References Cited

U.S. PATENT DOCUMENTS

| | | | | |
|---|---|---|---|---|
| 3,446,880 | A * | 5/1969 | Enicks | 264/46.6 |
| 3,585,639 | A * | 6/1971 | Enicks | 264/22 |
| 4,692,946 | A * | 9/1987 | Jurga | 2/22 |
| 5,274,846 | A * | 1/1994 | Kolsky | 2/460 |
| 5,340,352 | A * | 8/1994 | Nakanishi et al. | 450/57 |
| 5,452,475 | A * | 9/1995 | Hunt, Jr. | 2/22 |
| 5,491,840 | A * | 2/1996 | Yen | 2/461 |
| 5,570,470 | A * | 11/1996 | Miller | 2/22 |
| 5,611,080 | A * | 3/1997 | Skottheim | 2/16 |
| 5,784,715 | A * | 7/1998 | Buchanan | 2/22 |
| 6,065,152 | A * | 5/2000 | Parker | 2/22 |
| 6,305,031 | B1 * | 10/2001 | White | 2/455 |
| D571,047 | S | 6/2008 | Kamradt | |

(Continued)

OTHER PUBLICATIONS

International Searching Authority, International Search Report, dated Jun. 8, 2010.

(Continued)

*Primary Examiner* — Bobby Muromoto, Jr.
(74) *Attorney, Agent, or Firm* — Ice Miller LLP

(57) ABSTRACT

An energy absorbing and displacing structure for athletic protective equipment, such as an athletic shin-guard, is provided using a flexible web-shaped body to hold a rigid band-shaped member in place. The inner rigid band-shaped member follows the contour of the desired area to protect. The outer flexible web-shaped body is made of a softer rubber like material and works as a locator and supporter keeping the inner, rigid band-shaped member, in proper location.

20 Claims, 4 Drawing Sheets

(56) References Cited

U.S. PATENT DOCUMENTS

| | | | | |
|---|---|---|---|---|
| D593,258 | S | 5/2009 | Kamradt | |
| 7,917,971 | B2 * | 4/2011 | Kamradt | 2/455 |
| 2005/0108800 | A1 * | 5/2005 | White | 2/2.5 |
| 2006/0107433 | A1 * | 5/2006 | Olson | 2/22 |
| 2008/0072359 | A1 * | 3/2008 | Godshaw et al. | 2/24 |
| 2009/0077702 | A1 * | 3/2009 | Gabry et al. | 2/16 |
| 2009/0077703 | A1 * | 3/2009 | Gabry et al. | 2/16 |

OTHER PUBLICATIONS

International Searching Authority (ISA), Witten Opinion of the ISA, dated Jun. 8, 2010.

* cited by examiner

ENERGY ABSORBING AND DISPLACING STRUCTURE FOR ATHLETIC PROTECTIVE EQUIPMENT

PRIORITY

The present application is related to, claims the priority benefit of, and is a U.S. §371 national stage entry of, International Patent Application Serial No. PCT/US2010/000290, filed Feb. 2, 2010, which is related to, claims the priority benefit of, and is a continuation of U.S. Patent Application Serial No. 12/378,273, filed Feb. 13, 2009, which issued as U.S. Patent No. 7,917,971 on Apr. 5, 2011. The contents of the patent and each of these applications are hereby incorporated by reference in their entirety into this disclosure.

TECHNICAL FIELD

The present invention relates generally to protective equipment for an individual's body, for protecting against blows imparted upon the body during athletic competition.

BACKGROUND OF THE INVENTION

Body protective equipment is commonly worn by participants of contact sports for the purpose of preventing injuries. In these contact sports, various situations may cause injuries. Examples of these situations include tackling or otherwise bumping into other players, falling to the ground, being struck by another player's equipment, or being struck by a game ball itself. Of course, body protective equipment may reduce or prevent injuries resulting from various other circumstances, including those not associated with contact sports.

Existing body protective equipment utilize a relatively significant amount of foam padding for absorbing the energy of blows delivered to the body. Moreover, a rigid hard shell cover typically made of hard plastic, usually overlays the foam padding so as to distribute the force of the blow across a larger area of the foam padding. As is known in the art, distributing the force in this manner permits the foam padding to absorb only a portion of the energy associated with the blow.

A drawback of using a rigid hard shell cover is its limited ability to absorb and displace energy and its lack of flexibility to the user. Another drawback is that the combined use of the foam padding and the rigid hard shell cover adds relatively significant weight to the protective equipment. Since absorbing and displacement of energy is needed to prevent injury and flexible lightweight athletic equipment are known for allowing players freedom of movement, the ridged hard shell cover and its lack of energy absorbing and displacing properties and its lack of flexibility and the added weight are all undesirable results.

Therefore, a need exists for body protective equipment that can absorb and displace the energy from a powerful blow, is flexible, and is relatively lightweight.

Protective equipment also exists to protect other parts of the body from injury during contact athletic events. Such protective equipment includes shin guards, shoulder pads, kneepads, elbow pads, and hip pads. This protective equipment like the athletic shin-guard described above, is typically comprised of foam padding with a plastic cover and thus suffers from the same deficiencies discussed above.

Therefore, a need also exists for protective equipment for any part of the body that can absorb and displace the energy from a powerful blow, is flexible, and is relatively lightweight.

SUMMARY OF THE INVENTION

It is therefore an object of the present invention to provide protective equipment with improved protection for the body of an athlete.

It is another object of the present invention to provide protective equipment that is durable and can withstand a substantial number of blows over a significant period of time.

It is another object of the present invention to provide protective equipment that can absorb and displace the energy from blows.

It is yet another object of the present invention to provide protective equipment that is flexible, lightweight, and allows a user greater freedom of movement and to expend less energy carrying the equipment.

In accordance with the above and other objects of the present invention, a protective athletic shin-guard is provided for protection of blows imparted upon the body of a user. The protective athletic shin-guard includes an inner rigid band-shaped member that follows the curve of the shin bone and provides protection thereto and a outer flexible web-shaped body made of a softer rubber like material and works as a locator and supporter of the rigid band-shaped member, combined the structure works like a spring keeping the inner, rigid band-shaped member, in proper location away from the user allowing for compression.

The combination of these elements allows for the absorption and displacement of the energy of a blow delivered to an individual's body.

One advantage of the present invention is that a user is protected from harmful forces that may injure his shin, knee, and elbow, as well as other parts of the body.

Another advantage of the present invention is that it has a minimized weight for permitting a user to expend more energy participating in an ongoing activity.

Yet another advantage of the present invention is that it is flexible and allows a user greater freedom of movement.

Other advantages of the present invention will become apparent when viewed in light of the detailed description of the preferred embodiment when taken in conjunction with the attached drawings and appended claims.

BRIEF DESCRIPTION OF THE DRAWINGS

For a more complete understanding of this invention, reference should now be made to the embodiments illustrated in greater detail in the accompanying drawings and described below by way of examples of the invention.

DETAILED DESCRIPTION OF THE INVENTION

This description relates to the general comments herein, as well as the figures referred to above.

Figure 1:
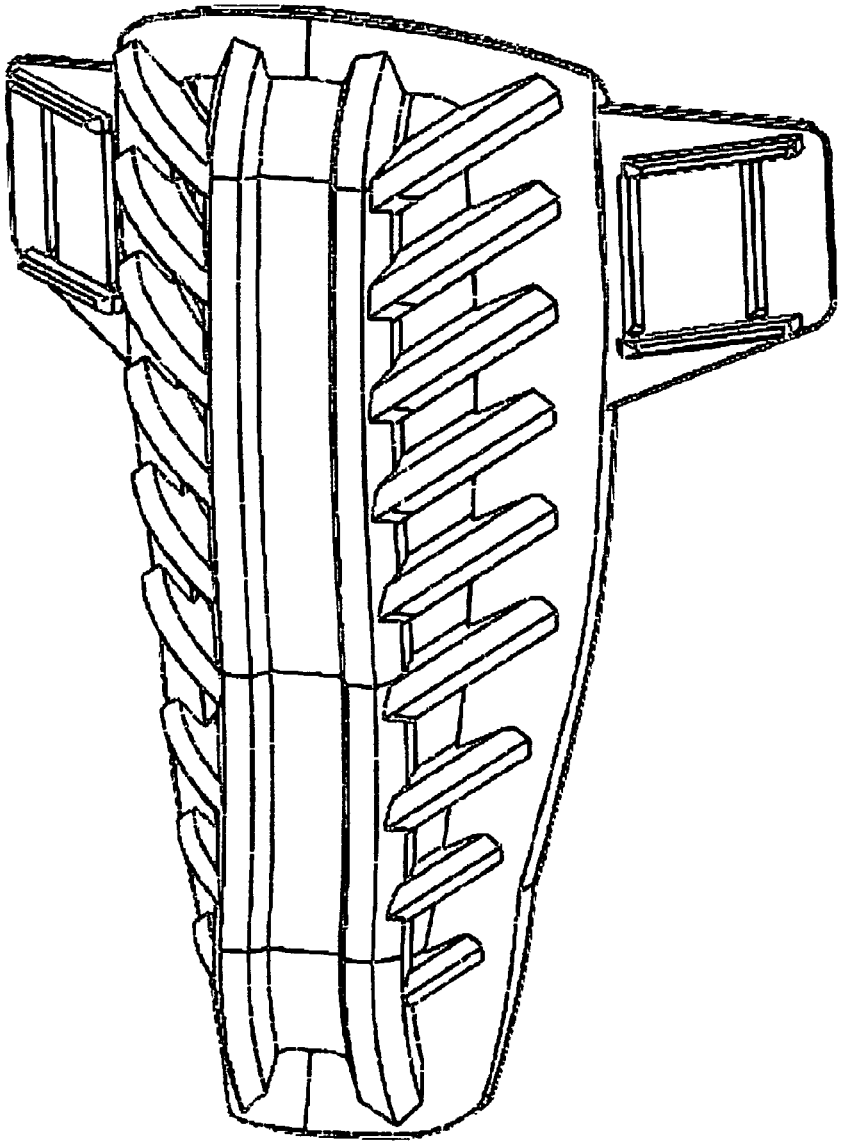
FIG. 1 is a front perspective view of the energy absorbing and displacing structure incorporated in a shin guard.

As noted, FIG. 1 is a front perspective view of the energy absorbing and displacing structure for athletic protective equipment therein. In FIG. 1, the structure is incorporated into an athletic shin-guard (1). The structure includes a rigid band-shaped member over molded with a flexible web-shaped body.

Figure 2:
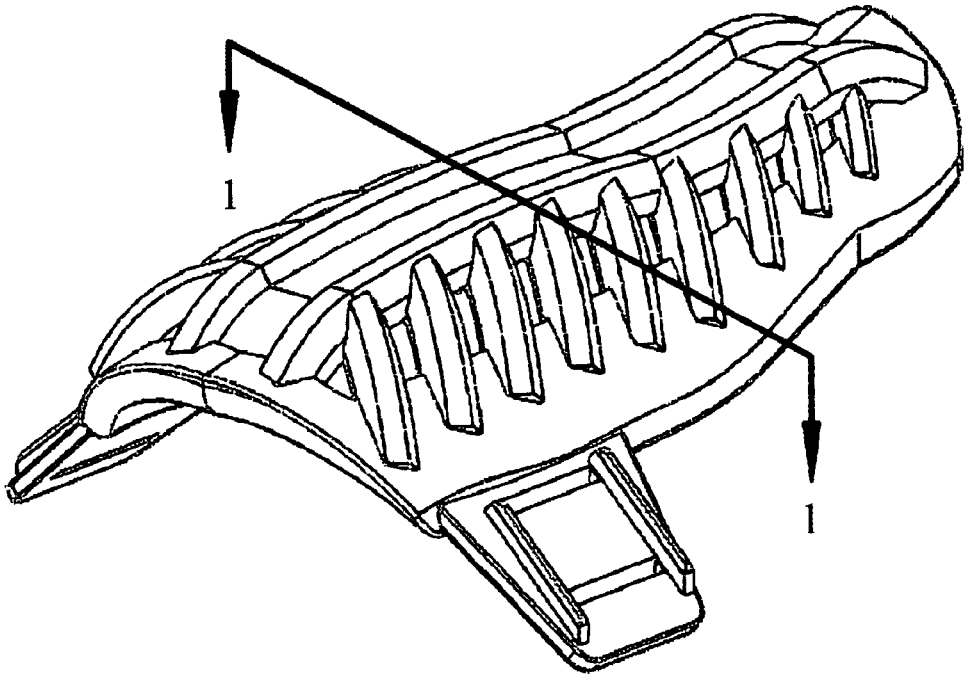
FIG. 2 is another perspective view of the energy absorbing and displacing structure incorporated in a shin guard.

FIG. 2 is yet another perspective view there of.

Figure 3:
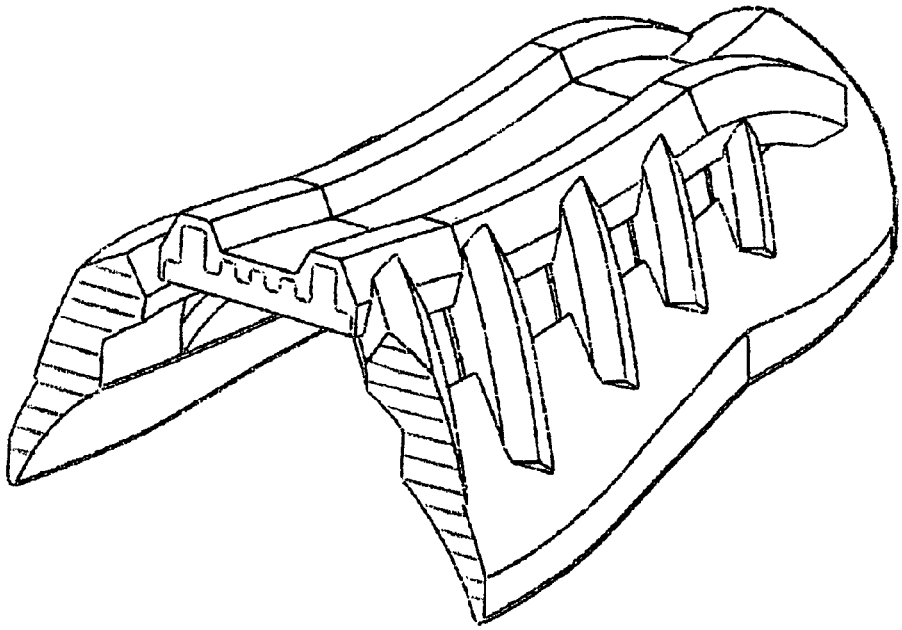
FIG. 3 is a cross-sectional view of the energy absorbing and displacing structure incorporated in a shin guard depicted in FIG. 2

Next, consistent with all of the foregoing, FIG. 3 is a cross-sectional view of the shin guard, illustrating the impact and energy absorbing structure. The rigid band shaped member (2) over-molded with the flexible web-shaped body (1) to provide enhanced impact and energy absorption. As depicted, the structure is pre-formed with the rigid band shaped member (2) made of a hard resilient material like polycarbonate, and the flexible web-shaped body (1) made of a rubber like material, each is combined in an over mold process to make a complete structure. The webbed like structure (1) is utilized to locate and support the rigid band shaped member (2), also unlike the prior art. As noted, this configuration provides the utmost in impact and energy absorption.

In the preferred mode, a flexible web-shaped body (1) is used to hold a rigid band-shaped member (2) in the desired location.

The inner rigid band-shaped member (2) follows the contour of the desired area to protect. The outer flexible web-shaped body (1) is made of a flexible rubber like material and works as an exoskeleton to hold the inner rigid band-shaped member (2), in the desired location.

Figure 4:
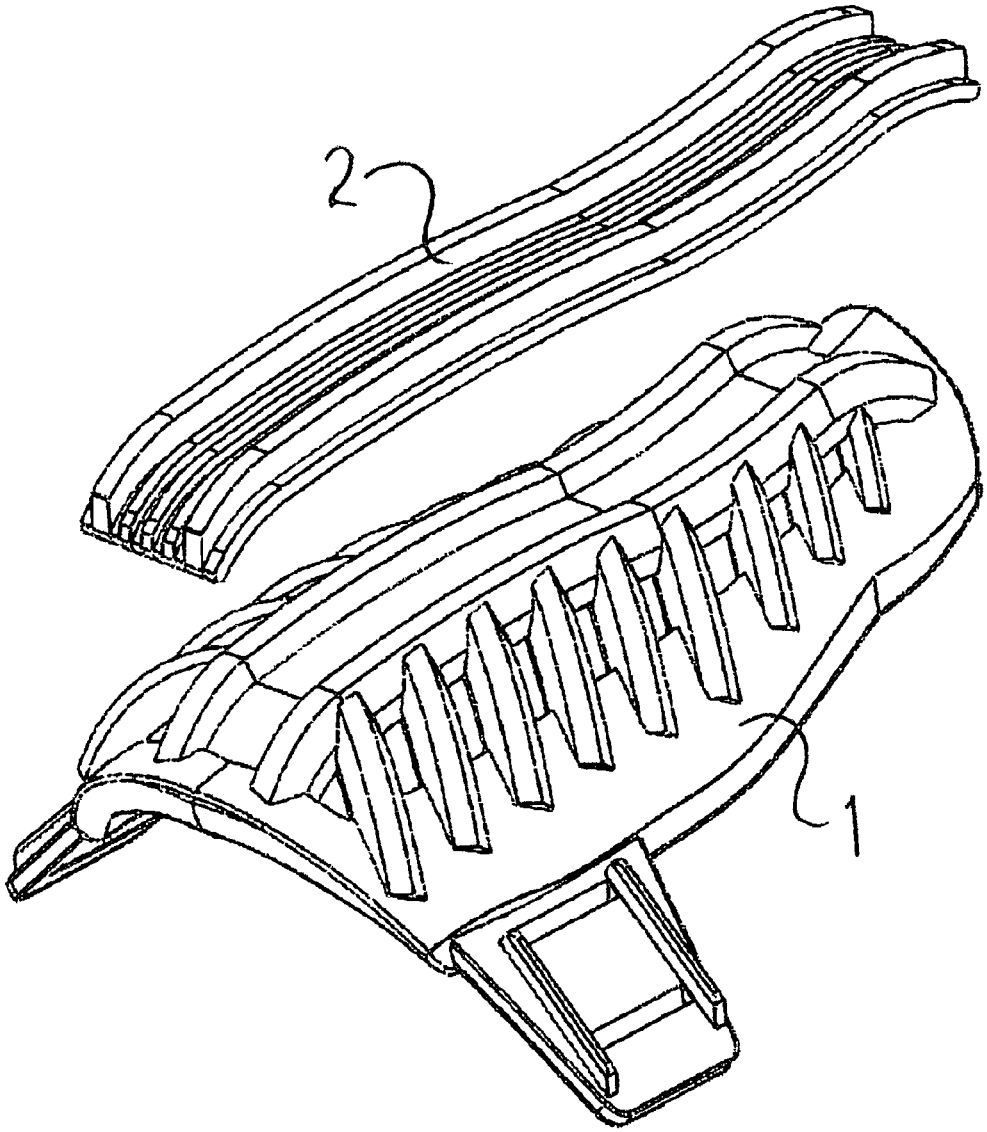
FIG. 4 is a perspective view of the energy absorbing and displacing structure incorporated in a shin guard separated into its components.

In an effort to make the most efficient use possible of the rigid band shaped member (2). In addition, FIG. 4 illustrates that the rigid band shaped member (2) is kept to a minimum and is only as big as the area it is to protect. The length and width will very in size and is dictated by the desired area to protect. For the purposes of example, a flexible web-shaped body (1) together with the rigid band shaped member (2) works like a spring and provides absorption and dissipation.

Combined as an assembly it creates a system for great distribution and spreading of forces, thereby reducing the adverse effects of impact in a manner previously unattained.

Importantly, the flexible web-shaped body (1) with its spring like design and rubber like properties working in conjunction inhibits the structure from bottoming out, or reaching their full capacity of energy absorption. Furthermore, the assembly provides for complete memory, which is instantaneous upon release of the force exerted. In addition, the structure functions to allow the outer portion of the assembly to receive primary forces, the flexible web-shaped body (1) directs and distributes forces to the user. As such, the assembly compresses in a unique manner to absorb the force and displace the energy of impact received.

FIG. 4 illustrates the assembly separated into its components. The combined structure allows for the rigid band shaped member (2) and the flexible web-shaped body (1) to work in unison, as opposed to a single rigid structure attempting to absorb all forces received. This simply allows for a far greater amount of energy absorbed by the assembly of the present invention. Thus, regarding the present invention embodied within an athletic shin-guard, the webbed structure will mitigate the incidence of pain and injuries.

The depiction of the invention within an athletic shin-guard is for example purposes only, as the impact and energy absorbing structure may also be utilized on items such as shoulder pads, knee pads, elbow pads, hip pads and other athletic protective equipment.

It should be noted that when two separate devices, each incorporating the assembly of the present invention, collide with one another, the level of energy absorbed and dissipated by the present invention is even greater than the already beneficial result received through usage of just a single such device.

Knee to knee or elbow-to-elbow type collisions are common in many contact sports such as lacrosse, soccer, football and hockey, and usage of the present invention by all players within a game will only reduce the incidence of injury by that much more.

Regarding the present invention and its applications of usage, it is important to distinguish the present invention from prior art structures wherein athletic protective equipment, rather than providing for flexibility and freedom of movement, are rigid, restrictive, and hinder movement. It is the purpose of the present invention to absorb and displace energy for the purpose of injury prevention and user safety while allowing for uninhibited freedom of movement. As such, the present system meets all rules and regulations of all major sports, rendering the same available for any physical activity.

In all such cases, the rigid band shaped member is manufactured in a variety of materials and sizes previously determined to render them effective for multiple previously determined sporting events and hazardous activities. Thus, the assembly may be utilized for protective devices in activities such as diving, swimming, ice hockey, roller hockey, roller skating, skateboarding, field hockey, soccer, lacrosse, football, arena football, gymnastics, baseball, auto racing, motorcycle racing, cycling, and track and field events.

It is imperative to note that the rigid band shaped member of the present invention may be tailored to absorb and dissipate foreseeable forces of humans and objects coming in contact with the assembly. As such, allowing for far greater adaptability to particular needs than traditional pads constructed of hard shell and foam and the like.

It is intended that the rigid band shaped member width also be variable according to particular needs. In all instances, the rigid band shaped member will vary in size in accordance to the area of desired protection, constantly allowing for a secure fit for each application.

Moreover, the impact and energy absorbing structure may be manufactured in a variety of previously determined sizes, functioning to render the assembly effective for multiple previously determined sporting events and hazardous activities. In any such instance, the use of the impact and energy absorbing structure will significantly reduce the quantity of padding and material needed, thus reducing weight to achieve the desired protection.

With regards to all descriptions and graphics, while the present invention has been illustrated and described as embodied, it is not intended to be limited to the details shown herein, since it will be understood that various omissions, modifications, substitutions and changes in the forms and details of the device illustrated, and in its operation, can be made by those skilled in the art without departing in any way from the spirit of the invention.

Without further analysis, the foregoing will so reveal the gist of the present invention that others can readily adapt it for various applications without omitting features that from the standpoint of prior art, constitute characteristics of the generic or specific aspects of this invention. What is claimed as new and desired to be protected by Letters Patent is set forth in the appended claims.

The embodiments of the invention in which an exclusive property or privilege is claimed are defined as follows:

1. A structure, comprising:

a middle portion comprising a rigid member, the middle portion extending along a longitudinal dimension of the structure; and an outer portion configured to contact a bodily surface, the outer portion coupled to the middle portion by way of a plurality of ribs, the plurality of ribs configured to space the middle portion away from the bodily surface;

wherein the structure is configured to absorb and displace energy upon impact.

2. The structure of claim 1, wherein the middle portion, the outer portion, and the plurality of ribs define a plurality of voids,

3. The structure of claim 1, wherein the outer portion and the middle portion each have a width, and wherein the width of the outer portion is wider than the width of is the middle portion.

4. The structure of claim 1, wherein the rigid member is relatively more rigid than the outer portion and the plurality of ribs,

5. The structure of claim 1, wherein the outer portion comprises a top end and a bottom end, and wherein the plurality of ribs extend from the middle portion in an angular direction toward the top end of the outer portion.

6. The structure of claim 1, further comprising:

at least one securing tab positioned on or coupled to the outer portion, the at least one securing tab configured to receive a second structure so that the structure can be held in place upon a user's body when the second structure is received thereby.

7. The structure of claim 1, wherein the middle portion further comprises an outer layer positioned external to the rigid member, the outer layer defining an outer surface and the rigid member defines an inner surface.

8. The structure of claim 7, wherein the outer layer is over-molded upon the rigid member.

9. The structure of claim 1, wherein the rigid member comprises a polycarbonate material.

10. The structure of claim 1, wherein the outer portion comprises a material selected from the group consisting of a flexible material and a rubber-like material.

11. The structure of claim 1, wherein the rigid member comprises a first material, wherein the outer portion and the plurality of ribs comprise a second material, and wherein the first material is relatively more rigid than the second material.

12. The structure of claim 1, wherein the structure is configured as an athletic supporter.

13. The structure of claim 1, wherein the structure is configured as a shin guard.

14. The structure of claim 1, wherein the structure is configured for placement upon a user's body at an area selected from the group consisting of the user's shoulder, the user's shin, the user's knee, the user's elbow, and the user's hip.

15. A structure, comprising:

a middle portion comprising a rigid member, the middle portion extending along a longitudinal dimension of the structure; and an outer portion configured to contact a bodily surface, the outer portion coupled to the middle portion by way of a plurality of ribs, the plurality of ribs configured to space the middle portion away from the bodily surface;

wherein the middle portion, the outer portion, and the plurality of ribs define a plurality of voids;

wherein the rigid member is relatively more rigid than the outer portion and the plurality of ribs; and wherein the structure is configured to absorb and displace energy upon impact.

16. The structure of claim 15, wherein the outer portion comprises a top end and a bottom end, and wherein the plurality of ribs extend from the middle portion in an angular direction toward the top end of the outer portion.

17. The structure of claim 15, wherein the rigid member comprises a first material, wherein the outer portion and the-plurality of ribs comprises a second material, and wherein the first material is relatively more rigid than the second material,

18. The structure of claim 15, wherein the structure is configured as a shin guard,

19. A shin guard, comprising:

a middle portion comprising a rigid member, the middle portion extending along a longitudinal dimension of the shin guard; and an outer portion configured to contact a bodily surface, the outer portion coupled to the middle portion by way of a plurality of ribs, the plurality of ribs configured to space the middle portion away from the bodily surface;

wherein the middle portion, the outer portion, and the plurality of ribs define a plurality of voids; and wherein the shin guard is configured to absorb and displace energy upon impact.

20. The shin guard of claim 19, further comprising:

at least two securing tabs positioned on or coupled to the outer portion, the at least two securing tabs configured to receive a structure so that the shin guard can be held in place upon a user's body when the second structure is received thereby.

* * * * *